US007553246B2

(12) United States Patent
Turzer

(10) Patent No.: US 7,553,246 B2
(45) Date of Patent: Jun. 30, 2009

(54) RACKET

(76) Inventor: Harald Turzer, Mariannenplatz 4, 10997 Berlin (DE)

( * ) Notice: Subject to any disclaimer, the term of this patent is extended or adjusted under 35 U.S.C. 154(b) by 18 days.

(21) Appl. No.: 11/235,303

(22) Filed: Sep. 26, 2005

(65) Prior Publication Data

US 2006/0073923 A1 Apr. 6, 2006

Related U.S. Application Data

(63) Continuation-in-part of application No. PCT/DE2004/000644, filed on Mar. 24, 2004.

(30) Foreign Application Priority Data

Mar. 24, 2003 (DE) ..... 203 05 073 U

(51) Int. Cl.
*A63B 49/08* (2006.01)
*A63B 49/02* (2006.01)

(52) U.S. Cl. ..... 473/549; 473/546; 473/526; 473/524

(58) Field of Classification Search ..... 473/524, 473/526, 531, 540, 549, 551; D21/729
See application file for complete search history.

(56) References Cited

U.S. PATENT DOCUMENTS 3,545,755 A * 12/1970 Owada ..... 473/526
4,131,278 A 12/1978 Goldenberg
4,147,348 A 4/1979 Lee
4,155,550 A 5/1979 Planakis
4,184,679 A * 1/1980 Mishel ..... 473/537
4,213,609 A * 7/1980 Swanson ..... 473/551

(Continued)

FOREIGN PATENT DOCUMENTS

BE 1005 097 4/1993

(Continued)

*Primary Examiner*—Raleigh W. Chiu
(74) *Attorney, Agent, or Firm*—Collard & Roe, P.C.

(57) ABSTRACT

The invention concerns a racket for ball and shuttlecock games such as tennis, squash or badminton.

Figure 1:
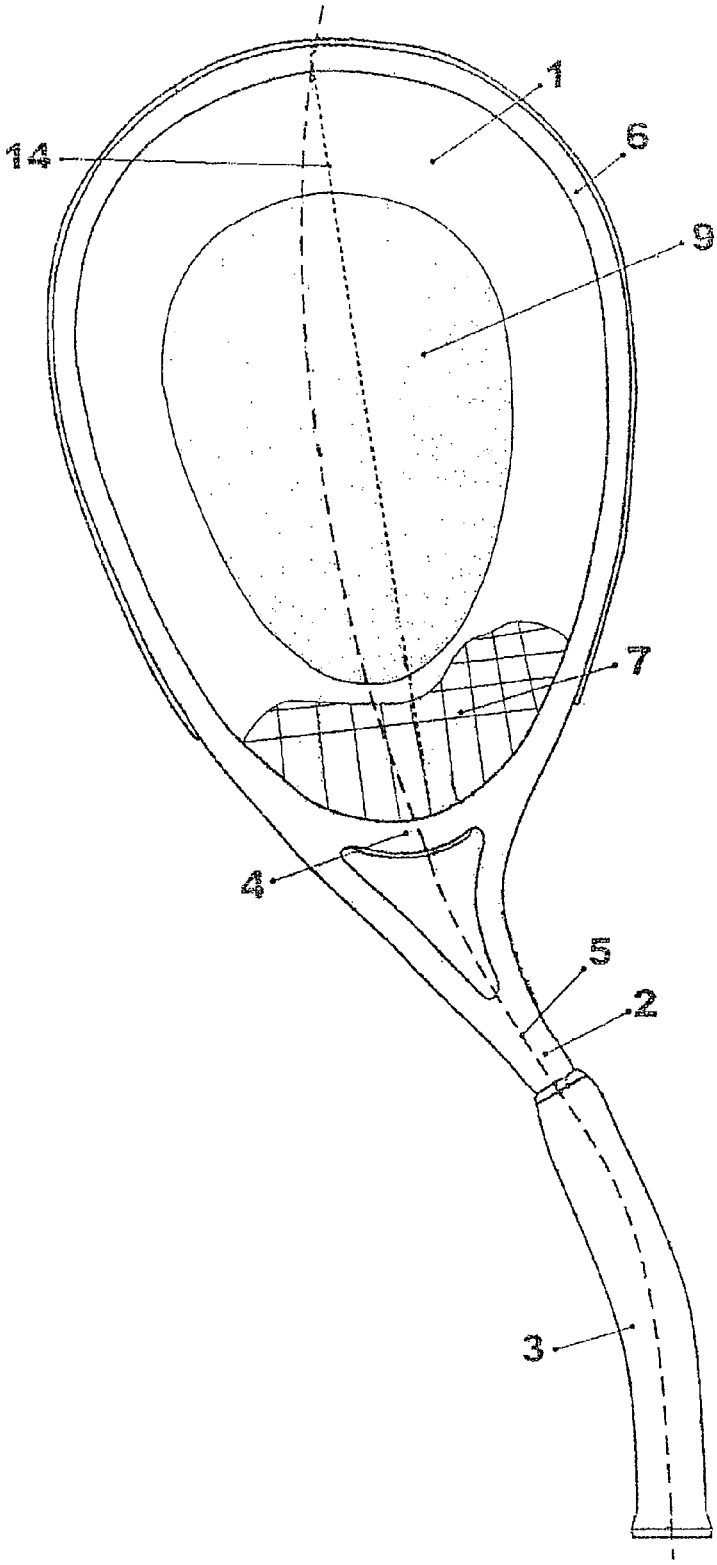

With the objective of generally improving the playing characteristics of the racket and to adapt the racket to the ergonomic movements of the layer on serving, receiving and returning the ball with more effective utilization of the striking force, the racket has an S shaped configuration throughout and has a midline 5 running in a common S shape for the striking part 1, the shaft 2 and the grip 3, such that the upper and lower points of intersection of the head frame 6 and the striking part 1 lie on the midline 5, while the arrangement of shaft 2 and grip 3 follows the course of the midline 5 in their longitudinal extension and the cross sections of the profiles 6.1; 6.2 of the headframe 6 and shaft 2 are different in the halves of the racket separated by the midline 5—FIG. 1.

The racket according to the invention has an arc-shaped grip 3 designed as a segment of a circle, designed and arranged with respect to the striking part 1 so that each of the tangents 10, 17 of the inner and outer arcs 16, 15 of the grip intersect the striking surface 9 of the striking part and the parts of the striking surface to the right side of the symmetry axis 14 of the striking part are limited on one side by an outermost tangent 10 running from the grip base 3.1 to the outer arc 15—FIG. 1.

11 Claims, 2 Drawing Sheets

U.S. PATENT DOCUMENTS

| | | | | | |
|---|---|---|---|---|---|
| 4,221,383 | A | * | 9/1980 | Cappelli | 473/526 |
| 4,360,201 | A | | 11/1982 | Biehl et al. | |
| 4,438,925 | A | * | 3/1984 | Lindstrom | 473/551 |
| 4,478,416 | A | | 10/1984 | Gibello | |
| 4,497,186 | A | | 2/1985 | Mason | |
| 4,659,080 | A | | 4/1987 | Stoller | |
| 4,664,380 | A | * | 5/1987 | Kuebler | 473/537 |
| 4,732,384 | A | * | 3/1988 | Seymour | 473/537 |
| 4,743,021 | A | | 5/1988 | Gonzales, Jr. | |
| 4,759,546 | A | | 7/1988 | Steele, Jr. | |
| 4,919,438 | A | | 4/1990 | Yoneeyama | |
| 4,997,186 | A | | 3/1991 | Carr | |
| 5,108,114 | A | * | 4/1992 | Marx | 473/531 |
| 5,560,600 | A | * | 10/1996 | FitzSimons et al. | 473/531 |
| 5,749,574 | A | * | 5/1998 | Curtis | 473/531 |
| 6,083,125 | A | * | 7/2000 | West | 473/549 |
| 2003/0036449 | A1 | * | 2/2003 | Kuncz et al. | 473/524 |
| 2006/0073923 | A1 | * | 4/2006 | Turzer | 473/526 |

FOREIGN PATENT DOCUMENTS

| | | | |
|---|---|---|---|
| DE | 24 07 213 | | 8/1975 |
| DE | 2407213 | | 8/1975 |
| DE | 34 34 956 | | 4/1986 |
| DE | 100 22 298 | | 11/2000 |
| FR | 2 696 351 | | 4/1994 |
| JP | 09019518 | A * | 1/1997 |
| WO | WO9014870 | | 12/1990 |
| WO | WO 01/87424 | | 11/2001 |

* cited by examiner

RACKET

CROSS REFERENCE TO RELATED APPLICATIONS

Applicant claims priority under 35 U.S.C. §119 of GERMAN Application No. 203 05 073.8 filed on Mar. 24, 2003. Applicant also claims priority under 35 U.S.C. §120 of International Application of PCT/DE2004/000644 filed on Mar. 24, 2004. This is a by-pass continuation in part of said International Application PCT/DE2004/000644 filed on Mar. 24, 2004. The international application under PCT article 21(2) was not published in English.

The invention concerns an improved racket for ball and shuttlecock games, such as tennis, squash, badminton, speedminton, and racketball.

Rackets for ball and shuttlecock games, with which the game ball is directed and the striking force of the player is transferred to the ball, are already known in extremely varied designs.

In the most widespread common designs—DE 34 34 956 A1, U.S. Pat. No. 4,997,186, and U.S. Pat. No. 4,919,438—the striking part, or the striking surface, is generally arranged symmetrically with respect to the axis of the grip. That means that the center of mass of the striking surface is on the axis of the grip, so that the extension of the grip axis is at the same time the longitudinal axis of the racket. There is a significant disadvantage for these rackets in the unfavorable position of the striking area with respect to the position of the player's hand and arm. The usual rackets with a straight longitudinal axis for the striking part, shaft, and grip do not fit the ergonomic requirements for an effective player-racket combination.

The straight-line longitudinal axis of the racket requires a correspondingly higher position of the player's playing arm to hit and return high balls. But the angle of the player's arm to the racket should be less than 45° for a hit to be carried out optimally considering coordination and force. That means that even slightly higher balls require ball returns that go beyond this optimal range of 45°. That requires more extreme coordination and exertion of more force by the players arm.

The straight-line symmetrical axis of striking part, shaft and grip further makes the racket an optimal resonant oscillator that conducts oscillations and/or vibrations directly to the player's playing arm when a ball is received and struck. That causes irritations of the player's arm with every strike. The player attempts to absorb those irritations by a firmer grip, the so-called "set in concrete" hand-grip. That, in turn, causes wrist cramps and convulsive phenomena, known as "tennis arm", as well as loss of coordination and energy. Because of the cramps, all the muscle groups from the individual fingers through the arm up to the shoulder must be relaxed after each hit, re-coordinated, and newly fixed again. That causes losses of time, concentration, and energy. The racket is fixed in the hand grip, and so affects the muscle groups of the hand and the lower arm muscles and tendons connected with them. The "tennis arm" that results is, therefore, the sum of the continuous overstressing and chronic fatigue and abrasion phenomena that occur with every hit.

Rackets have been designed with the objective of avoiding the disadvantages mentioned above as well as to stabilize the racket grip, to increase the proportion of hits, to give the player more safety for the whole game, and at the same time to make movement more variable during play. In those rackets the striking part or the striking area, or the racket grip are angled in comparison to the straight-line axis of symmetry or longitudinal axis of the racket (DE 24 07 213 C1, FR 2 696

351, U.S. Pat. No. 4,131,278, U.S. Pat. No. 4,155,550, U.S. Pat. No. 4,478,416, U.S. Pat. No. 4,659,080). The tennis racket known from WO90/14870 is also one of those racket designs, having the center of gravity of the striking head displaced from the extended axis of the grip. In that design, the striking part of the tennis racket is arranged with respect to the straight grip part so that the extended grip axis intersects the striking area of the racket head, but the center of gravity of the racket head is displaced by a specific extent. The desired rotational stability is assured for these rackets only if the ball strikes the striking area at an angle of 90° when the striking area is exactly vertical. Because of the displacement of the center of gravity of the racket heat from the extended grip axis, every blow at which the ball it not struck at an angle of 90° to the vertically held striking area results in undesired rotational moments, increasing the disadvantageous consequences, as described in the further discussions. As it is only in the rarest cases that the ball can strike the striking area directly in the extension of the grip axis, the resulting rotational moments due to the design and form of the striking part and grip of the tennis racket cannot be compensated or counteracted by a change in the manner of holding the grip or in the grip position. That is the situation for all rackets with a straight grip axis, and also for WO 01/87424 A2.

Tennis rackets with an S-shaped arrangement of the striking part, bar and hand-grip are also known from U.S. Pat. No. 4,147,348, WO 01/87424 A2 and BE 1005097 A5. While the extended grip axis of the hand grip, made in a straight line, intersects the center of gravity of the striking part, in the designs according to U.S. Pat. No. 4,147,348 and BE 1005097 A5 it is far outside the striking area, and thus far outside the sweet spot. In the case of BE 1005097 A5 the extended axis of the grip actually runs parallel to the longitudinal axis of the striking part. The common, and critical, disadvantage of these racket designs is that there is an extremely high rotational moment from receiving and returning the ball. This high rotational moment can be counteracted only with high expenditure of force and even stronger fixation of the racket grip in the hand of the player. A variable and controlled return of the [ball is] therefore almost impossible.

Furthermore, non-unsymmetrical profiles have also been suggested for the hand-grip. They are intended to improve the trip technology so as to fix the racket even more strongly in the player's hand and to increase the transfer of the striking force to the racket—DE 100 22 298 A1, U.S. Pat. No. 4,759,546, DE 24 07 213 C1.

An ergonomic profile of the hand-grip, which establishes the position of the hand on the grip, is also suggested in U.S. Pat. No. 4,147,348 and BE 1005097, [which is] certainly advantageous for fixing the racket in the player's hand and for transfer of the striking force. The play angle between the striking surface and the ball impact can be changed only by rotating the wrist and not by a variable alteration of the grip position of the hand on the grip part of the racket. That would be an advantage, for instance, for balls played higher.

A racket for racketball and tennis having an ergonomic profiled hand-grip and a striking surface that is designed and arranged asymmetrically with respect to an extended grip axis is known from U.S. Pat. No. 4,360,201. This racket has essentially the same disadvantageous playing characteristics as were described above.

A racket with the hand-grip in the form of an arc is already known from U.S. Pat. No. 4,743,021. This racket, again, has an arrangement of bar and striking surface on a straight midline, with the disadvantages that were described in more detail previously on page 1, Paragraph 3.

The placement and shape of the sweet spot are critically important for effectively serving, receiving, and returning the ball. It is in the center of the striking part and extends correspondingly over unequal lengths of the longitudinal and transverse axes of the striking part to the edge of the striking part. The region outside this sweet spot is increasingly unfavorable because of the increasing stress on the stringing and because of the unfavorable force level when the ball is being returned. Play with these segments of the striking part is significantly less coordinated and requires higher force input.

In returning the ball, control of the ball is of primary importance. It should continue as long as possible. The longer the longitudinal and transverse axes of the sweet spot, the more flexible is the string of the stringing of the striking part that is in contact with the ball. This increases the distance that the playing ball moves back in the stringing of the striking part, and it can be guided and controlled longer in this way. Tolerance along the longitudinal axis of the sweet spot is, therefore, considerably more advantageous than tolerance along the shorter transverse axis. That is typically the case for slice and top-spin balls with the usual rackets, which have a straight-line longitudinal axis.

The known rackets described above, having a striking part at an angle to the straight axis of the racket, already have an extended path for guidance and control of the ball after it strikes the stringing of the striking port, and they thus have a larger sweet spot with the advantages that gives for receiving and returning the ball. But if the ball strikes on surfaces of the striking part that are outside the enlarged sweet spot, an unequally higher lever moment occurs, that can be counteracted only with increased application of force. This higher lever moment causes rotation of the shaft with the grip and leads to loss of control and force.

In the more highly developed rackets with the grip parts at an angle to the straight longitudinal axis, the relations are similar. The angled grip does reduce the load on the wrist joint, but every ball impacting on the striking part causes a lever moment that is outside the force line of the playing arm. With an angled grip, the force lines pass far outside the striking part, and so can counteract only part of the lever moment that occurs.

In summary, it is determined that angling the striking part or the grip can match the ergonomics better to the course of movement. On the other hand, though, these racket designs produce a negative force level that has unfavorable effects on receiving and returning the ball.

Therefore the invention is based on the objective of developing a racket with generally improved playing characteristics that are largely adapted to the ergonomic motions of the player in receiving and returning the playing ball, and still makes possible more effective utilization of the striking force.

This objective is attained according to the invention with a racket according to the features of Patent Claim 1. Advantageous further embodiments of the racket according to the invention appear from subsidiary claims 2 to 7.

The racket according to the invention has an overall S-shaped configuration. It has a common S-shaped midline for the striking part, shaft and grip, which runs so that the uppermost and lowermost points of intersection of the head frame and the striking part lie on the midline, while the arrangement of shaft and grip follow the midline in their longitudinal elongation and the cross-sections of the profiles of the head frame and shaft are different in the halves of the racket divided by the midline.

One of the significant advantages of the new racket is that the vibrations that occur on serving, receiving and returning the ball are not conducted on into the mass of the playing arm, or even amplified, as is the case with rackets having a straight-line longitudinal axis. The S-shaped configuration of the racket, and especially of the shaft, acts like a spring and absorbs a large part of the vibrations that occur. The racket according to the invention damps the resonance of the vibration, and so contributes to preservation of the playing arm. The vibration-damping effects can be strengthened even more by enlarging the profile cross section that is provided in the vicinity of the end of the grip—Claim 3.

The S-shaped configuration of the racket does not result in the recommended racket being more extensively adapted than the designs known up to now with respect to the ergonomic movements in serving, receiving and returning the ball. Rather, it results, advantageously, in shifting of the striking part with respect to a center of gravity axis passing through the center of gravity of the grip. In comparison with ordinary rackets, then, the ball can be played higher with the same angle between the playing arm and the player's body. This property, which is of particular advantage in play at the net, reduces the force required and increases control of the ball when it is hit.

The curvature of the grip, with its initial and final points lying on the S-shaped midline of the racket, also supports the variable use of the racket according to the invention for both forehand and backhand balls, and makes possible even better utilization of the advantages given by shifting or angling the striking part. Also, the grip is even better matched to the player's grasp. That results in a larger grip contact through which the racket is even better fixed in the player's hand. At the same time, the curved grip is an effective lever against rotations of the racket caused by balls that are not received and hit with the sweet spot.

A further significant advantage of the racket according to the invention consists primarily in that the S-shaped configuration and the common S-shaped mid-line compensates (mutually eliminates) for the undesirable lever moments which arise from an angled arrangement of the grip and/or striking part.

With the shift or angling of the striking part, as described above, the intersection of the axes of the sweet spot rotates with respect to the flight path of the incoming ball and at the same time the effective area of the sweet spot changes. Thus the incoming ball is not accepted primarily by the longitudinal strings of the racket stringing. as is generally the case for rackets with a straight-line longitudinal axis. Instead, it is received by the longitudinal and transverse strings of the stringing, which are directed approximately diagonally to the flight path of the ball—Claim 4. This advantageous effect can be further increased if the longitudinal strings of the striking do not run parallel to a line connecting the outermost points of the head frame of the striking part, but are arranged somewhat diagonally—Claim 5. Then the ball must move a longer way into the stringing of the striking part, thus getting longer guidance. At the same time, the comprehensive control of the ball increases. The quasi-double guidance of the ball along the longitudinal and transverse axes of the stringing gives not only improved control of the ball but also more efficient transfer of the striking force to the ball.

Effective serving and the sliced and top-spun balls require spinning the ball when it is struck. To do that, the player usually places the racket at a slight angle to the flight path of the ball, so as to intersect it and apply a turning effect to the ball. As a result, the striking force is not completely transferred to the ball. Force is lost.

Due to the S-shaped configuration of the racket according to the invention, the angular position of the striking part related to that, and the guidance of the struck or incoming ball on the transverse and longitudinal strings of the stringing of the striking part, supplemented by the arrangement of the stringing, as described above, the ball receives a rotation about its own axis, which gives the ball a spinning effect without the player having to spin it. The entire striking force of the blow is thus transferred to the ball.

Without negatively affecting the improved playing properties and other advantageous properties, the racket according to the invention can be given a symmetric or asymmetric striking part. The racket, again, has an S-shaped configuration. With the asymmetric form of the striking part, the length of the long sides of the stringing increases at the same time, as does the length of the striking lever. That results in a greater striking force and a larger area of the sweet spot, which improves the guidance and control of the ball on the striking part.

On the other hand, the asymmetric form of the striking part gives imbalances, which produce rotational moments in the course of striking the ball. These rotational moments are desirable to the extent that they transfer a spin to the ball. However, they are undesirable and disadvantageous if these rotational moments become very strong and the racket tends to twist in the player's hand. This situation is counteracted according to the invention by the fact that the profile of the cross section of shaft and striking part are unequal in the opposing halves of the racket separated by the longitudinal axis—Claim 1.

The racket according to the invention is advantageously made in one piece—Claim 6. The individual functional groups of the racket can be made separately and firmly combined with each other in an assembly process using force fits and/or shape fits to simplify the production if desired, and to decentralize it—Claim 7.

Figure 2:
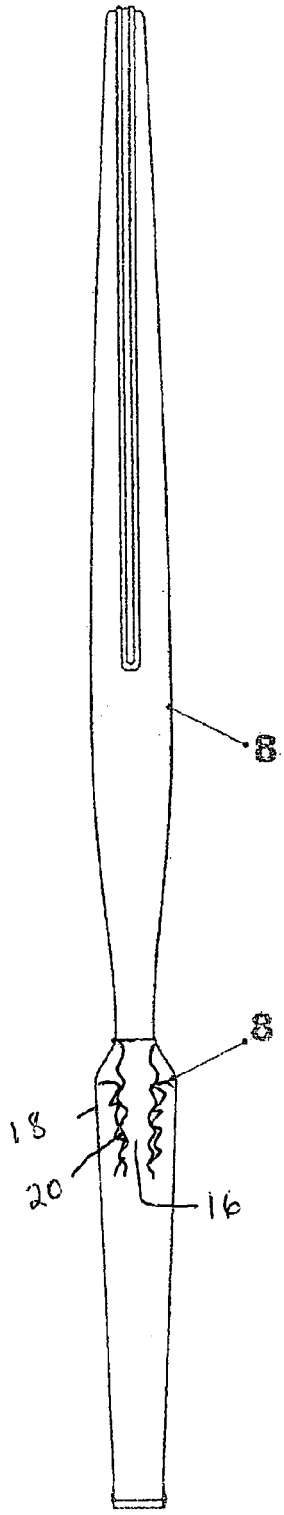
Figure 3:
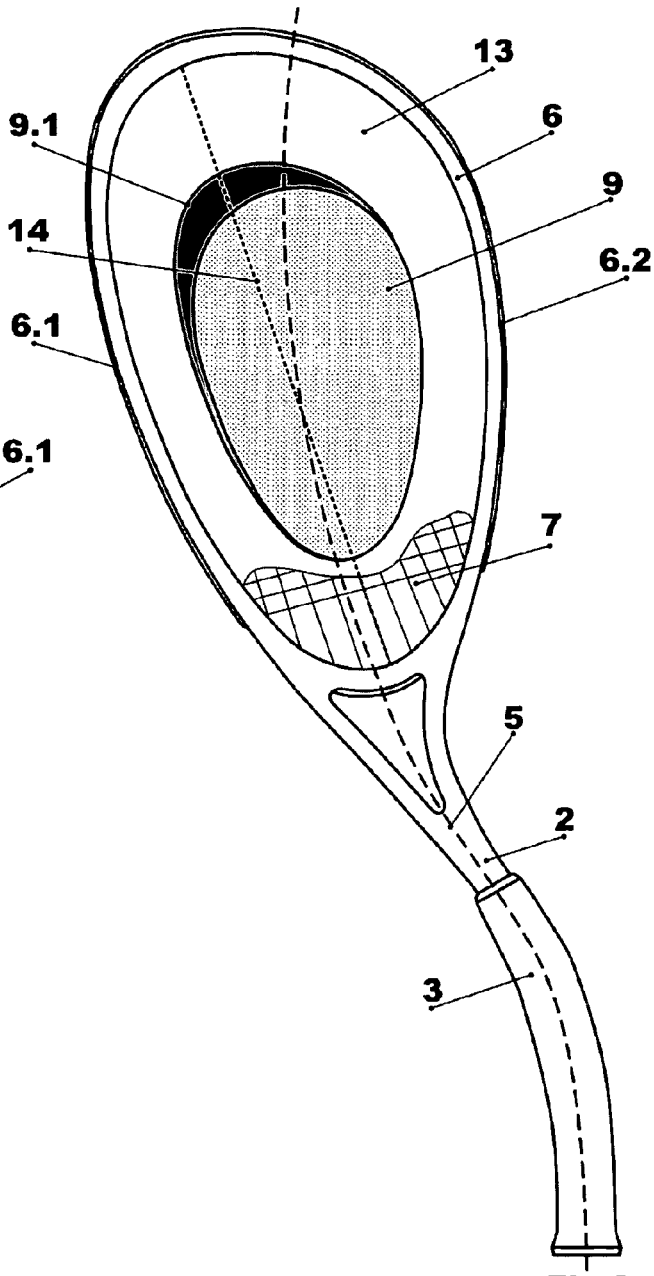

The invention will be explained in more detail in the following. The accompanying drawings show:

FIG. 1 A schematic representation of a racket made according to the invention with a symmetrically shaped striking part;

FIG. 2 A side view of the racket of FIG. 1;

FIG. 3 A racket made according to the invention with an asymmetric striking part.

Figure 5:
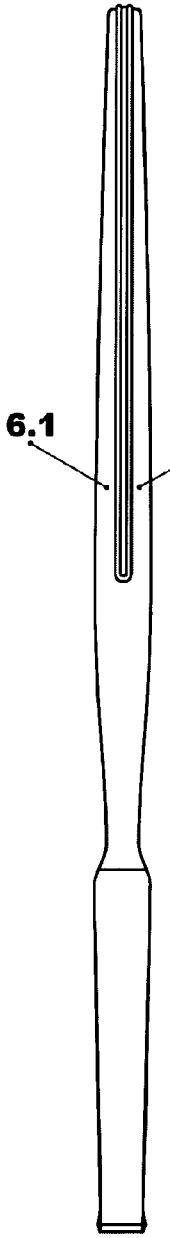
Figure 4:
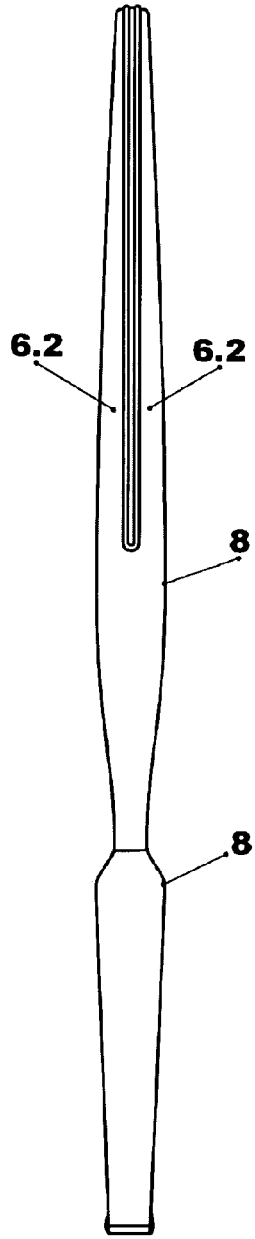

FIGS. 4 and 5 The left and right side views of the racket according to FIG. 3.

As FIG. 1 shows, the racket made according to the invention has an S-shaped configuration throughout, with a midline 5 running in an S shape, on which the initial points and final points of the functional elements of the racket, the striking part 1, shaft 2 and grip 3, are arranged. The racket shown has a symmetrical striking part 1, formed by the head frame 6 and the stringing 7. This new structural form gives a series of advantageous properties, which have already been presented comprehensively in the preceding discussions. To avoid repetitions, these improved playing and other advantageous properties will not be discussed in detail in this part of the description of the invention.

The grip 3, designed in an arc shape, contributes to stabilization and to a variable form of the racket mounting. It is also even better matched to the player's grasp and as a result can be fixed even more firmly in the player's hand.

Because of the S-shaped curve of the midline 5, the intersection of the axes of the sweet spot 9 also rotates with respect to the flight path of the incoming ball. As already stated, this gives significant advantages in receiving and returning the ball, because it passes along a longer path on the stringing of the striking part 1 and so can be guided and controlled better. Because of the rotation of the intersection of the axes of the sweet spot 9, the longitudinal and transverse strings run somewhat diagonally to the flight path of the ball. In contrast to the previously known rackets, the ball is guided along an extended path along both the longitudinal strings and the transverse strings. That increases the transfer of the striking force to the ball, which is simultaneously rotated about its own axis. In this way the ball is given an additional spinning effect without the player having to spin the ball separately. These advantageous effects can be increased more by the longitudinal strings of the stringing 7 being arranged not parallel to a connecting line 14 between the outermost points of the head frame 5 of the striking art 1, but somewhat diagonally to this line 14.

Another measure to enlarge the effective area of the sweet spot 9 consists of omitting, in a manner which is itself known, the crossbar 4 of the head frame 6 and leading the longitudinal and transverse strings of the stringing of the striking part 1 up to the head region of the shaft 2 and anchoring them there.

The arc-shaped form of the grip 3 continues in the structural design of the shaft 2, whereby the initial and end points of the grip 2 likewise lie on the midline 5 of the racket, which runs in an S-shape. The design of the shaft 2 acts like a spring and damps the vibrations that occur in receiving and striking the ball. The damping characteristics of the recommended racket can additionally be increased still more by widening the profile cross section 8 in the vicinity in the region of the area where the bar 2 and grip 2 connect.

The racket made according to the invention and shown in FIG. 3 has an asymmetric striking part 1. This configuration of the striking part 1 enlarges the sweet spot 9 and the sweet spot area 9.1. At the same time the striking lever of the racket lengthens, with the result that a higher striking force can be transferred to the ball. The increased area of the sweet spot also provides better guidance and control of the ball during its contact with the stringing of the striking part 1.

To counter potential problems produced by striking the ball by high rotational moments due to the asymmetric form of the striking part 1, the profiles 6.1; 6.2 of the head frame 6 and of the shaft 2 have different profile cross sections in the halves of the racket separated by the midline 5. By a suitable choice of these differing profile cross sections, the imbalances of the racket due to the asymmetric shape of the striking part 1 can be compensated.

The racket has the striking part (1), the shaft (2) and the grip (3) being made separately as individual components and being solidly connected together by force fit of inner part 16 into outer part 18 and or by interlocking means 20 to make a complete racket, as shown by FIG. 2.

The invention claimed is:

1. Racket for ball and shuttlecock games such as tennis, squash, badminton, speedminton, or racketball, comprising a striking part (1) formed by a head frame (6) with stringing (7), a shaft (2) and an arc-shaped grip (3), wherein the racket has an S-shaped configuration throughout and a midline (5) running in a common S shape for the striking part (1), the shaft (2) and the grip (3), such that the uppermost and lowermost intersection points of the head frame (6) and the striking part (1) lie on the midline (5), while the arrangement of shaft (2) and grip (3) follows the course of the midline (5) in its longitudinal extension and the cross sections of the profiles (6.1; 6.2) of the head frame (6) and shaft (2) are different in the halves of the racket separated by the midline (5);

wherein the configuration of the shaft acts like a spring and damps the vibrations that occur, and wherein the tangents of the midline of the grip run through or intercept with the striking part of the racket.

2. Racket according to claim 1, wherein the striking part (1) is asymmetrically shaped and has an enlarged sweet spot surface (9.1).

3. Racket according to claim 1, wherein the profile cross section (8) of the grip (3) is widened in the region of a grip head.

4. Racket according to claim 1 wherein the longitudinal strings of the stringing run parallel to a connecting line (14) between the outermost points of the head frame (6) and the transverse strings of the stringing are arranged at an angle of approximately 90~ to the longitudinal strings.

5. Racket according to claim 1 wherein the longitudinal strings of the stringing run approximately diagonally with respect to a connecting line (14) between the outermost points of the head frame (6) and the transverse strings are arranged at an angle of approximately 90° to the diagonally running longitudinal strings.

6. Racket according to claim 1 wherein it is made in one piece.

7. Racket according to claim 1 wherein the striking part (1), shaft (2) and grip (3) are made separately as individual components and are solidly connected together by force fit and or by interlocking to make a complete racket.

8. Racket for ball and shuttlecock games such as tennis, squash, badminton, speedminton, or racketball, comprising a striking part (1) formed by a head frame (6) with stringing (7), a shaft (2) and an arc-shaped grip (3), wherein the racket has an S-shaped configuration throughout and a midline (5) running in a common S shape for the striking part (1), the shaft (2) and the grip (3), such that the uppermost and lowermost intersection points of the head frame (6) and the striking part (1) lie on the midline (5), while the arrangement of shaft (2) and grip (3) follows the course of the midline (5) in its longitudinal extension;

wherein the configuration of the shaft acts like a spring and damps the vibrations that occur; and wherein the tangents of the midline of the grip run through or intercept with the striking part of the racket.

9. Racket for ball and shuttlecock games such as tennis, squash, badminton, speedminton, or racketball, comprising a striking part (1) formed by a head frame (6) with stringing (7), a shaft (2) and an arc-shaped grip (3), wherein the racket has an S-shaped configuration throughout and a midline (5) running in a common S shape for the striking part (1), the shaft (2) and the grip (3), such that the uppermost and lowermost intersection points of the head frame (6) and the striking part (1) lie on the midline (5), while the arrangement of shaft (2) and grip (3) follows the course of the midline (5) in its longitudinal extension and the cross sections of the profiles (6.1; 6.2) of the head frame (6) and shaft (2) are different in the halves of the racket separated by the midline (5);

wherein the configuration of the shaft acts like a spring and damps the vibrations that occur; and wherein the racket has the curvature of the shaft being opposite to the direction of the curvature of the arc-shaped grip and the shaft being asymmetrical and/or the shaft consisting of two branches.

10. Racket for ball and shuttlecock games such as tennis, squash, badminton, speedminton, or racketball, comprising a striking part (1) formed by a head frame (6) with stringing (7), a shaft (2) and an arc-shaped grip (3), wherein the racket has an S-shaped configuration throughout and a midline (5) running in a common S shape for the striking part (1), the shaft (2) and the grip (3), such that the uppermost and lowermost intersection points of the head frame (6) and the striking part (1) lie on the midline (5), while the arrangement of shaft (2) and grip (3) follows the course of the midline (5) in its longitudinal extension;

wherein the configuration of the shaft acts like a spring and dames the vibrations that occur; and wherein the racket has the curvature of the shaft being opposite to the direction of the curvature of the arc-shaped grip and the shaft being asymmetrical and/or the shaft consisting of two branches.

11. Racket for ball and shuttlecock games such as tennis, squash, badminton, speedminton, or racketball, comprising a striking part (1) formed by a head frame (6) with stringing (7), a shaft (2) and an arc-shaped grip (3), wherein the racket has an S-shaped configuration throughout and wherein the shaft is curved in a direction opposite to the direction of the curvature of the arc-shaped grip and wherein the tangents of the midline of the grip run through or intercept with the striking part of the racket and wherein the configuration of the shaft acts like a spring and damps the vibrations that occur.

* * * * *